United States Patent [19]

Tamura et al.

[11] Patent Number: 4,678,180

[45] Date of Patent: Jul. 7, 1987

[54] SELECTIVE SHEET FEEDER

[75] Inventors: Kaoru Tamura; Kawai Yasuhiro; Isao Utsumi, all of Kanagawa, Japan

[73] Assignee: Fuji Photo Film Co., Ltd., Kanagawa, Japan

[21] Appl. No.: 789,812

[22] Filed: Oct. 21, 1985

[30] Foreign Application Priority Data

Oct. 20, 1984 [JP] Japan ..... 59-220677
Oct. 20, 1984 [JP] Japan ..... 59-220678
Apr. 18, 1985 [JP] Japan ..... 60-84030

[51] Int. Cl.[4] ..... B65H 39/115

[52] U.S. Cl. ..... 271/296; 271/191; 271/200

[58] Field of Search ..... 271/296, 292, 293, 300, 271/191, 200

[56] References Cited

U.S. PATENT DOCUMENTS 3,450,030 6/1969 Hütz ..... 271/191 X
3,572,695 3/1971 Janirek ..... 271/191
4,002,249 1/1977 Shinomiya ..... 271/200 X
4,330,200 5/1982 Kikuchi ..... 271/296 X
4,354,674 10/1982 Dorer .

*Primary Examiner*—Richard A. Schacher
*Attorney, Agent, or Firm*—Sughrue, Mion, Zinn, Macpeak & Seas

[57] ABSTRACT

A selective sheet feeder includes a plurality of trays and a sheet feed unit movable over the trays and including a conveyor. The sheet feed unit with a sheet held on the conveyor is moved toward and stopped over a prescribed one of the trays. Then, the conveyor is driven by a rotational drive source for discharging the sheet into the prescribed tray.

17 Claims, 21 Drawing Figures

SELECTIVE SHEET FEEDER

BACKGROUND OF THE INVENTION

The present invention relates to a selective sheet feeder, and more particularly to a selective sheet feeder for feeding sheets such as stimulable phosphor sheets selectively into trays or bins according to their size or kind.

There has in recent years been proposed a radiation image recording and reproducing system in which a radiation image of an object can be produced by using a stimulable phosphor. The stimulable phosphor, when exposed to a radiation such as X-rays, $\alpha$-rays, $\beta$-rays, $\gamma$-rays, cathode rays, or ultraviolet rays, stores a part of the energy of the radiation. When the stimulable phosphor exposed to the radiation is exposed to stimulating rays such as visible light, the stimulable phosphor emits light in proportion to the stored energy of the radiation.

The radiation image recording and reproducing system employs such a stimulable phosphor. More specifically, the radiation image of an object such as a human body is stored in a sheet having a layer of stimulable phosphor (hereinafter referred to as a "stimulable phosphor sheet" or a "phosphor sheet"), and then the stimulable phosphor sheet is scanned with stimulating rays such as a laser beam to cause the stimulable phosphor sheet to emit light representative of the radiation image. The emitted light is then photoelectrically detected and converted to an electric image signal which is processed to reproduce a visible image on a recording medium such as a photographic film material or on a display unit such as a cathode ray tube (CRT). The aforesaid radiation image recording and reproducing system is disclosed in U.S. Pat. No. 4,258,264, for example.

The radiation image recording and reproducing system of the type described above is of greater practical advantage than conventional radiographic systems using a combination of an intensifying screen and an X-ray film in that images can be recorded in a wide range of radiation exposure. More specifically, it is known that the amount of light emitted from a stimulable phosphor upon stimulation thereof is proportional in a highly wide range to the amount of radiation to which the stimulable phosphor has been exposed. Therefore, even if the amount of radiation to which the stimulable phosphor is exposed varies widely under various conditions, radiation images free from such exposure variations can be obtained by selecting a suitable read-out gain in the photoelectric transducer for reading and converting the emitted light into an electric signal, and processing the electric signal into a visible image on a recording medium such as photographic film material or on a display unit such as a CRT.

The radiation image recording and reproducing system is capable of processing a converted electric signal to produce a visible image on a recording medium or a display unit so that the radiation image can well be observed for diagnostic purpose. In this system, the stimulable phosphor sheet does not serve as a final image recording medium, but as a temporary image storage medium for eventually transferring images to the final recording medium or display unit. Therefore, the stimulable phosphor sheet can be used repeatedly, and is economical and convenient if in repetitive use.

To reuse the stimulable phosphor sheet, the remaining radiation energy on the stimulable phosphor sheet after the radiation image has been read out by stimulating rays is discharged by exposure to light, and the stimulable phosphor sheet is employed again for recording a radiation image thereon. The erasure of the radiation energy from the stimulable phosphor sheet is disclosed in U.S. Pat. No. 4,400,619, for example.

The stimulable phosphor sheet which has been exposed to intensive erasing light to erase any remaining image information therefrom may be immediately used for recording another radiation image thereon or may temporarily be stored in a tray or bin in preparation for a next image recording cycle.

Where stimulable phosphor sheets of different sizes and kinds are employed and temporarily stored prior to each image recording cycle, it is preferable that the stimulable phosphor sheets of one size or kind be stored in the same tray. More specifically, stimulable phosphor sheets of different sizes and kinds are normally required to record different zones of an object in different areas as radiation images. In case stimulable phosphor sheets of one size or kind are stored in the same tray, they can quickly and accurately be supplied from the tray for recording next radiation images.

One system for sorting out different sheets includes a plurality of vertically arranged trays which are selectively accessible by a vertically movable device for storing the sheets selectively into the tray according to their size or kind. This sorter is complex in overall construction, and requires a large installation space. Therefore, it is not suitable for use in sorting out stimulable phosphor sheets after image information has been read therefrom upon exposure to stimulating light and any remaining image has been erased therefrom upon exposure to erasing light in a radiation image recording and reproducing system, since the radiation image recording and reproducing system is desired to be composed of unitized components and to be compact in structure. Another problem with this sorter is that its sorting speed is low. After the vertically movable device has received a sheet at a given position, it is moved to a prescribed tray and then delivers the sheet into the tray. Then, the vertically movable device returns to the given position for receiving another sheet. Therefore, the next sheet cannot be fed before the vertically movable device moves back to the given position, with the result that a large time loss is unavoidable in the operation of the sorter.

SUMMARY OF THE INVENTION

It is an object of the present invention to provide a selective sheet feeder of a simple structure for reliably storing stimulable phosphor sheets selectively into a plurality of different trays according to their size or kind.

Another object of the present invention is to provide a selective sheet feeder of a simple structure for reliably storing, at a high speed, stimulable phosphor sheets selectively into a plurality of different trays according to their size or kind.

Still another object of the present invention is to provide a selective sheet feeder comprising: a plurality of trays having openings directed upwardly and inclined at a prescribed angle; and a sheet feed unit movable along a travel path over the trays, the sheet feed unit including a casing, belt conveyor means disposed in the casing, and a rotational drive source for driving the belt conveyor means, the sheet feed unit with a sheet held on the belt conveyor means being movable toward and stoppable in a position over a prescribed one of the trays, and the belt conveyor means being drivable by the rotational drive source for discharging the sheet into the prescribed tray.

A still further object of the present invention is to provide a selective sheet feeder comprising: a plurality of trays having openings directed upwardly and inclined at a prescribed angle; and a sheet feed unit having a casing and movable along a travel path over the trays, the sheet feed unit including a belt conveyor for discharging a sheet carried thereon in the casing into one of the trays and a rotational drive source for driving the belt conveyor; detecting means for detecting the position of the sheet feed unit; designating means for designating a tray dependent on the sheet carried on the belt conveyor; and control means for moving the sheet feed unit until the position of the sheet feed unit detected by the detecting means conincides with a tray position designated by the designating means and for energizing the rotational drive means to drive the belt conveyor in the tray position.

Still another object of the present invention is to provide a selective sheet feeder comprising: a plurality of trays having openings directed upwardly and inclined at a prescribed angle; and a sheet feed unit movable along a travel path over the trays, the sheet feed unit having a casing, a belt conveyor having one end disposed in the casing for delivering a sheet, and a rotational drive source for driving the belt conveyor, the sheet feed unit being movable toward and stoppable in a position over a prescribed one of the trays, and the belt conveyor being drivable by the rotational drive source for discharging the sheet into the prescribed tray through the opening thereof.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
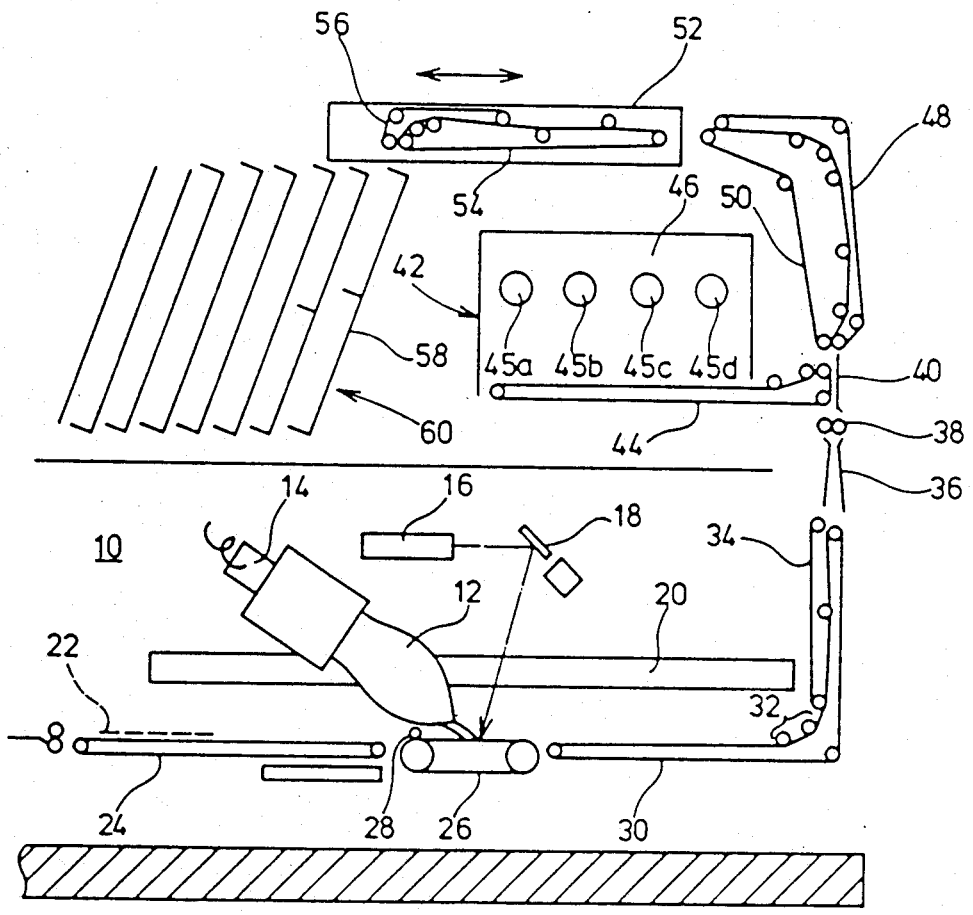
FIG. 1 is a schematic cross-sectional view of a radiation image reproducing system incorporating a selective sheet feeder according to the present invention.

Like or corresponding reference characters denote like or corresponding parts throughout the drawings.

A radiation image reproducing system in which a selective sheet feeder according to the present invention will first be described with reference to FIG. 1.

The radiation image reproducing system is essentially comprised of an image read-out unit 10, a radiation image erase unit 42 combined with the image read-out unit 10, a selective feed unit 52 for selectively feeding stimulable phosphor sheets, and a sheet sorter 60. The image read-out unit 10 includes a light guide 12, a photomultiplier 14, a laser beam source 16, and a galvanometer mirror 18, which are supported by a fixed optical plate 20 in a spaced fashion. A stimulable phosphor sheet 22 is fed to the light guide 12 by a first belt conveyor 24 having an outlet end positioned closely to an adjacent second belt conveyor 26 disposed beneath the light guide 12. A nip roller 28 is disposed near one of the rollers of the second belt conveyor 26 for gripping the stimulable phosphor sheet 22. The second belt conveyor 26 has an outlet end near a bent third belt conveyor 30 having a bent portion against which a first group of rollers 32 is held. A fourth belt conveyor 34 is located in contact with a portion of the third belt conveyor 30 which extends upwardly beyond the bent portion thereof. Directly above the third and fourth belt conveyors 30, 34, there are disposed first guide members 36 confronting a second guide member 40 with a pair of rollers 38 interposed therebetween. The second guide member 40 is associated with the image erase unit 42. More specifically, the second guide member 40 is positioned in facing relation to a fifth belt conveyor 44 extending below a casing 46 of the image erase unit 42. The image erase unit 42 houses a plurality (four in the illustrated embodiment) of erase light sources 45*a* through 45*d*.

A bent sixth belt conveyor 48 is positioned directly above the fifth belt conveyor 44 and the second guide member 40, and a bent seventh belt conveyor 50 is held against the sixth belt conveyor 48. The sixth and seventh belt conveyors 48, 50 have outlet ends facing the selective feed unit 52 for sorting stimulable phosphor sheets 22 according to their size.

The selective feed unit 52 has an eighth belt conveyor 54 and a ninth belt conveyor 56 held in contact therewith, and can itself be moved horizontally in the directions of the arrow. The sorter 60 is disposed below the selective feed unit 52 and composed of a plurality of trays or bins 58 inclined at an angle in parallel relation to each other.

Figure 2:
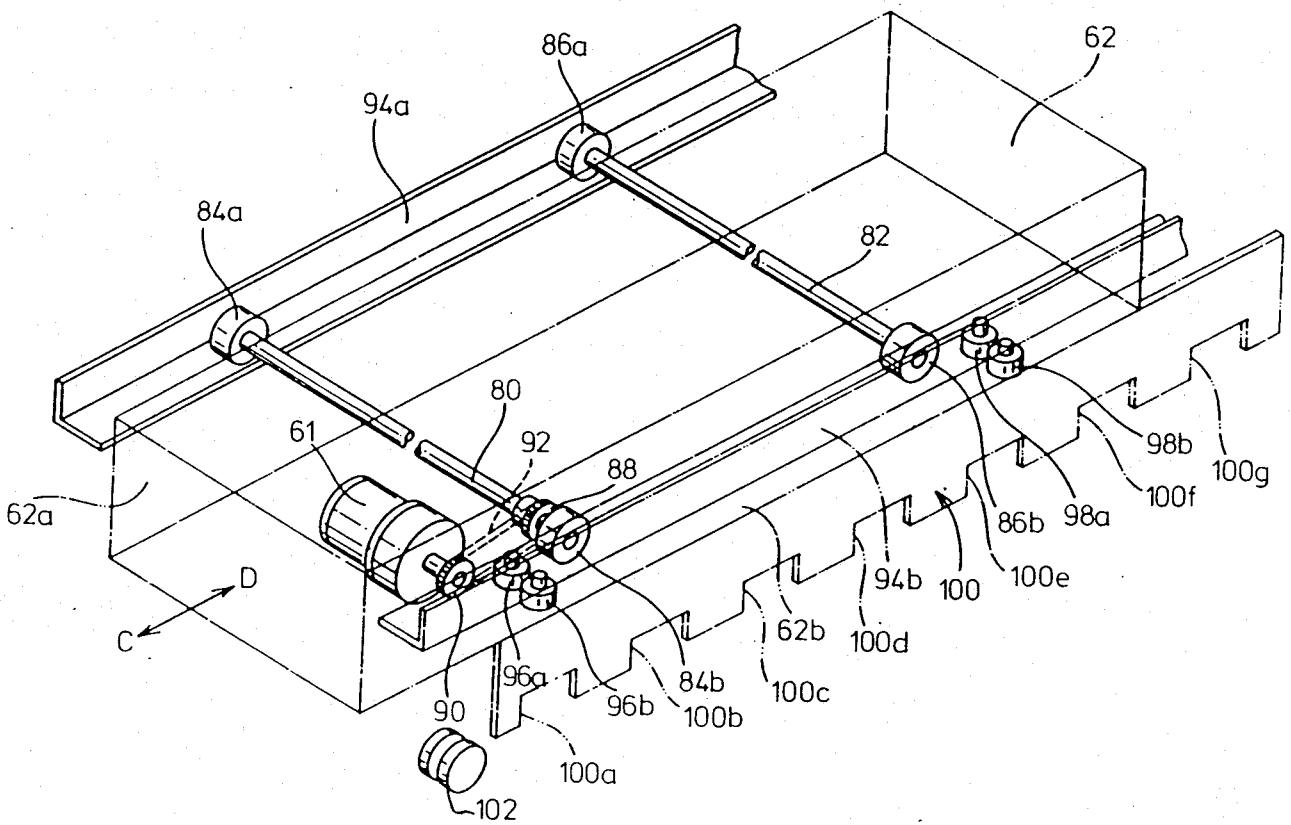
FIG. 2 is a perspective view of a self-propelling mechanism of the selective sheet feeder.
Figure 3:
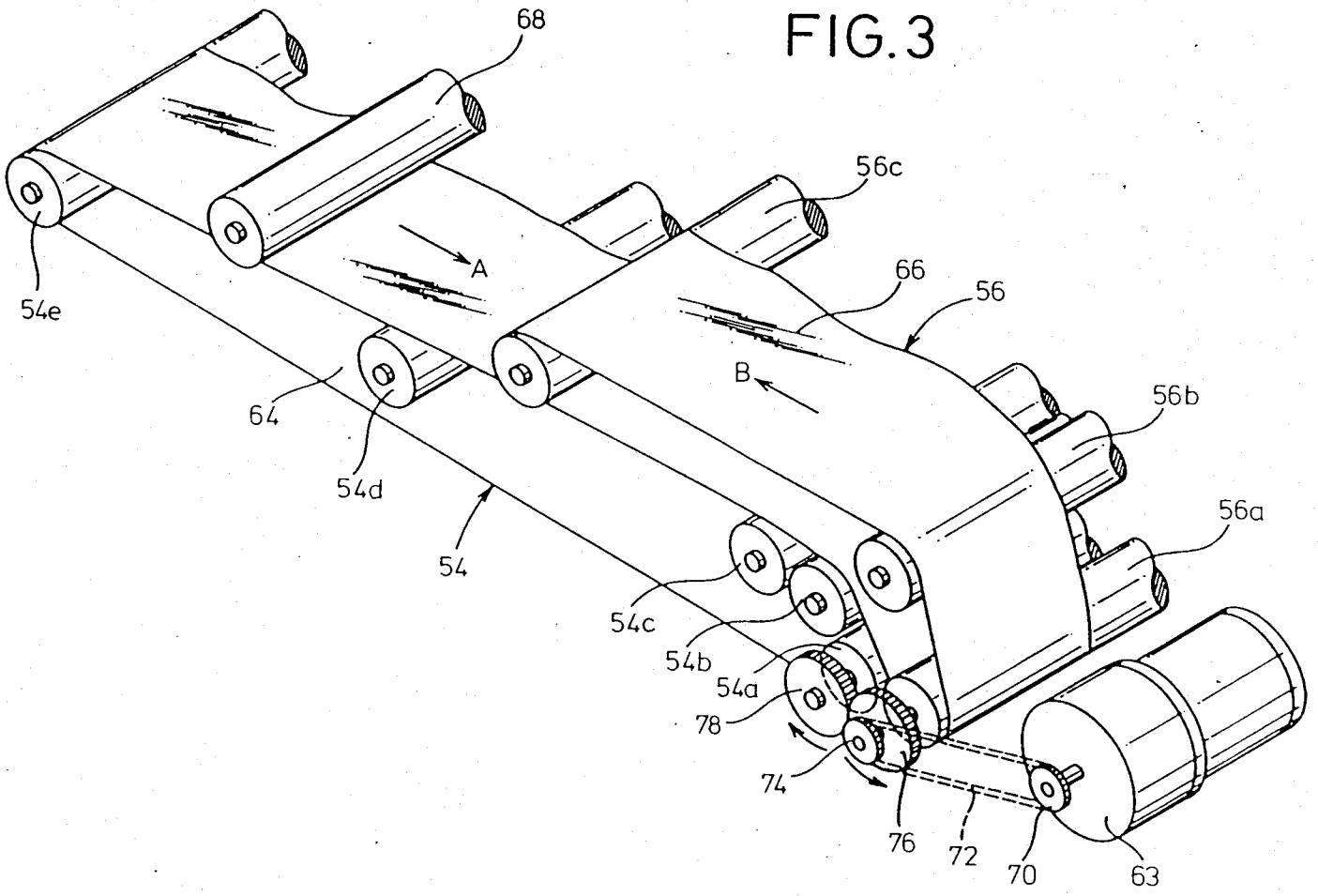
FIG. 3 is a fragmentary perspective view of a belt drive mechanism of the selective sheet feeder.
Figure 4:
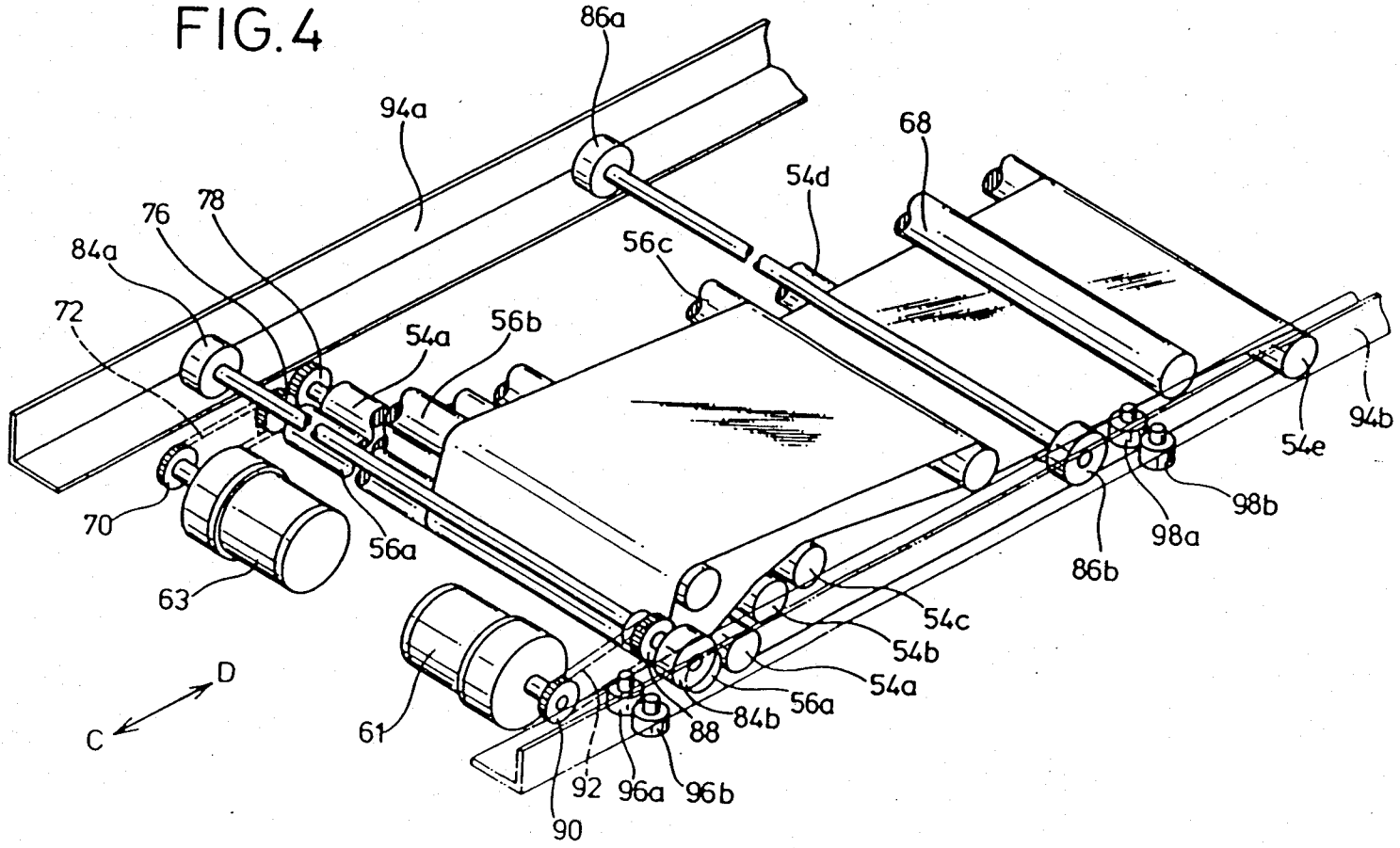
FIG. 4 is a fragmentary perspective view of the self-propelling mechanism and the belt drive mechanism which are combined with each other.

The selective feed unit 52 will be described in greater detail with reference to FIGS. 2 through 6. The selective feed unit 52 includes a casing 62 composed of side panels **62*b*, 62*a* respectively supporting a self-propelling motor 61 and a motor 63 for driving belt conveyors 54, 56 (FIGS. 2 through 4). The side panels 62*a*, 62*b* also support rollers 54*a* through 54*e* of the belt conveyor 54, around which a conveyor belt 64 is trained as shown in FIG. 3. The belt conveyor 56 includes rollers 56*a* through 56*c* around which a conveyor belt 66 is trained. The rollers 54*e*, 56*c* have rotatable shafts positionally adjustable for adjusting the tension of the conveyor belts 64, 66**.

As shown in FIG. 3, the rollers **54*a*, 56*a* are disposed closely to each other. An auxiliary roller 68 is disposed on the conveyor belt 64. The belt driving motor 63 has a rotatable shaft over which a sprocket 70 is mounted. A chain 72 is trained around the sprocket 70 and a sprocket 74 mounted on the rotatable shaft of the roller 56*a* which drives the belt conveyor 56. A gear 76 is mounted on the rotatable shaft of the roller 56*a***.

The roller **54*a* for driving the belt 64 has a rotatable shaft on which there is mounted a gear 78 held in mesh with the gear 76. Therefore, when the motor 63 is energized, its rotative power is transmitted through the sprocket 70, the chain 72, and the sprocket 74 to the gear 76 for thereby rotating the gear 78 in a direction opposite to that of rotation of the gear 76. As a result, the belts 64, 66 are driven to run in mutual contact over a certain range. At this time, the auxiliary roller 68 cooperates with the belt 64 in feeding the stimulable phosphor sheet 22 having reached the belt 64** in the direction of the arrow A.

As shown in FIGS. 2 and 4, two parallel rotatable shafts 80, 82 spaced from each other are rotatably supported on and extend between the side panels **62*a*, 62*b* of the casing 62. Rollers 84*a*, 84*b* are mounted respectively on the opposite ends of the rotatable shaft 80, and rollers 86*a*, 86*b* are mounted respectively on the opposite ends of the rotatable shaft 82. A sprocket 88 is mounted on the rotatable shaft 80. The self-propelling motor 61 has a rotatable shaft on which a sprocket 90 is mounted. A chain 92 is trained around the sprockets 88, 90. When the self-propelling motor 61 is energized, the rotative power is transmitted through the sprocket 90 and the chain 92 to the sprocket 88. The rollers 84*a*, 84*b* and the rollers 86*a*, 86*b* rollingly ride on the horizontal portions of parallel angle members 94*a*, 94*b* defining a travel path over the trays 58. Therefore, upon transmission of the rotative power from the motor 61 to the rollers 84*a*, 84*b*, these rollers 84*a*, 84*b* are positively driven to roll on the angle members 94*a*, 94*b* for thereby moving the casing 62 therealong. A pair of guide rollers 96*a*, 96*b* and another pair of guide rollers 98*a*, 98*b* are rotatably mounted on the casing 62 in gripping relation to the vertical portion of the angle member 94*b* for moving the casing 62 smoothly and reliably along the angle members 94*a*, 94*b***.

Figure 5:
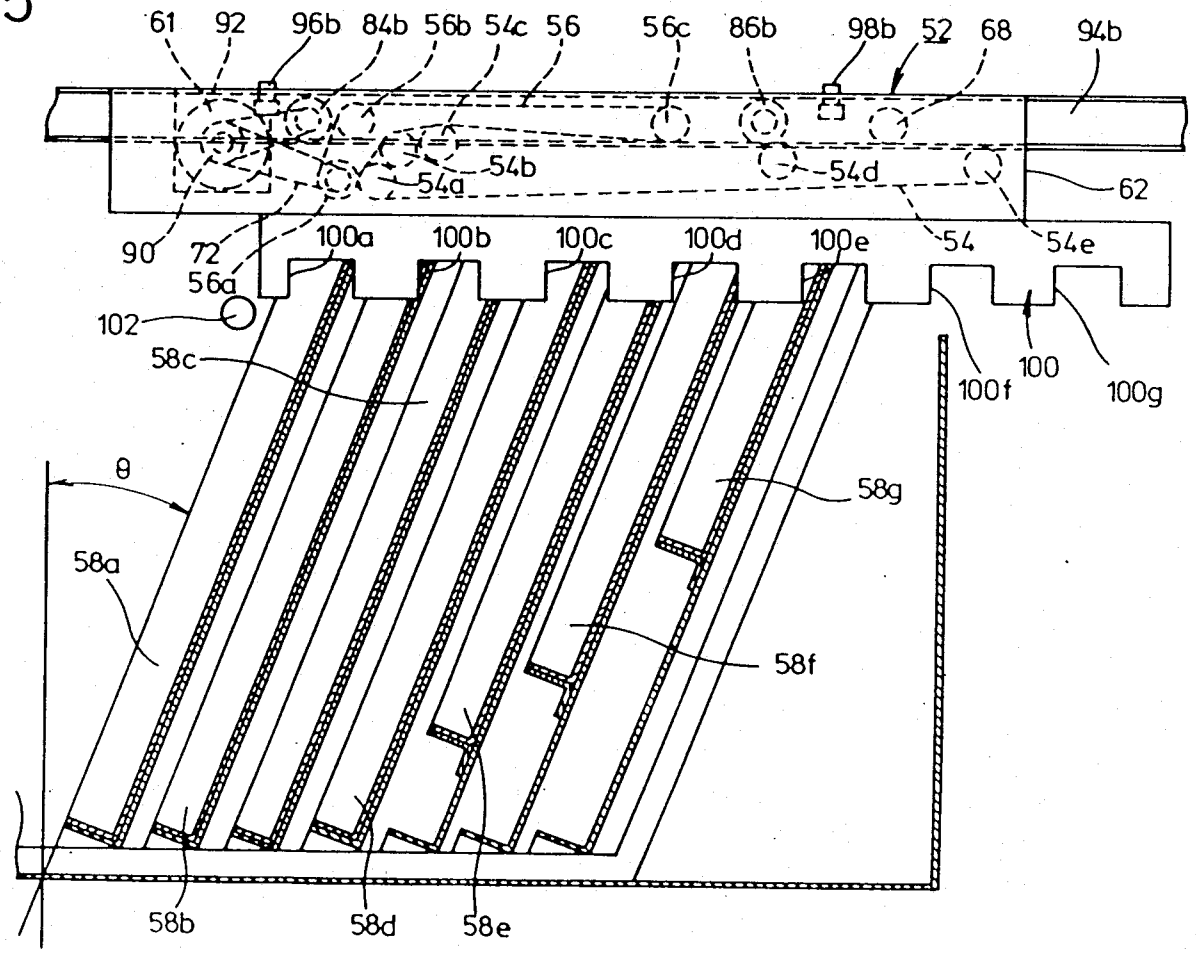
FIG. 5 is a front elevational view of the selective sheet feeder of the invention and a plurality of trays, shown in cross section, disposed below the selective sheet feeder.
Figure 6:
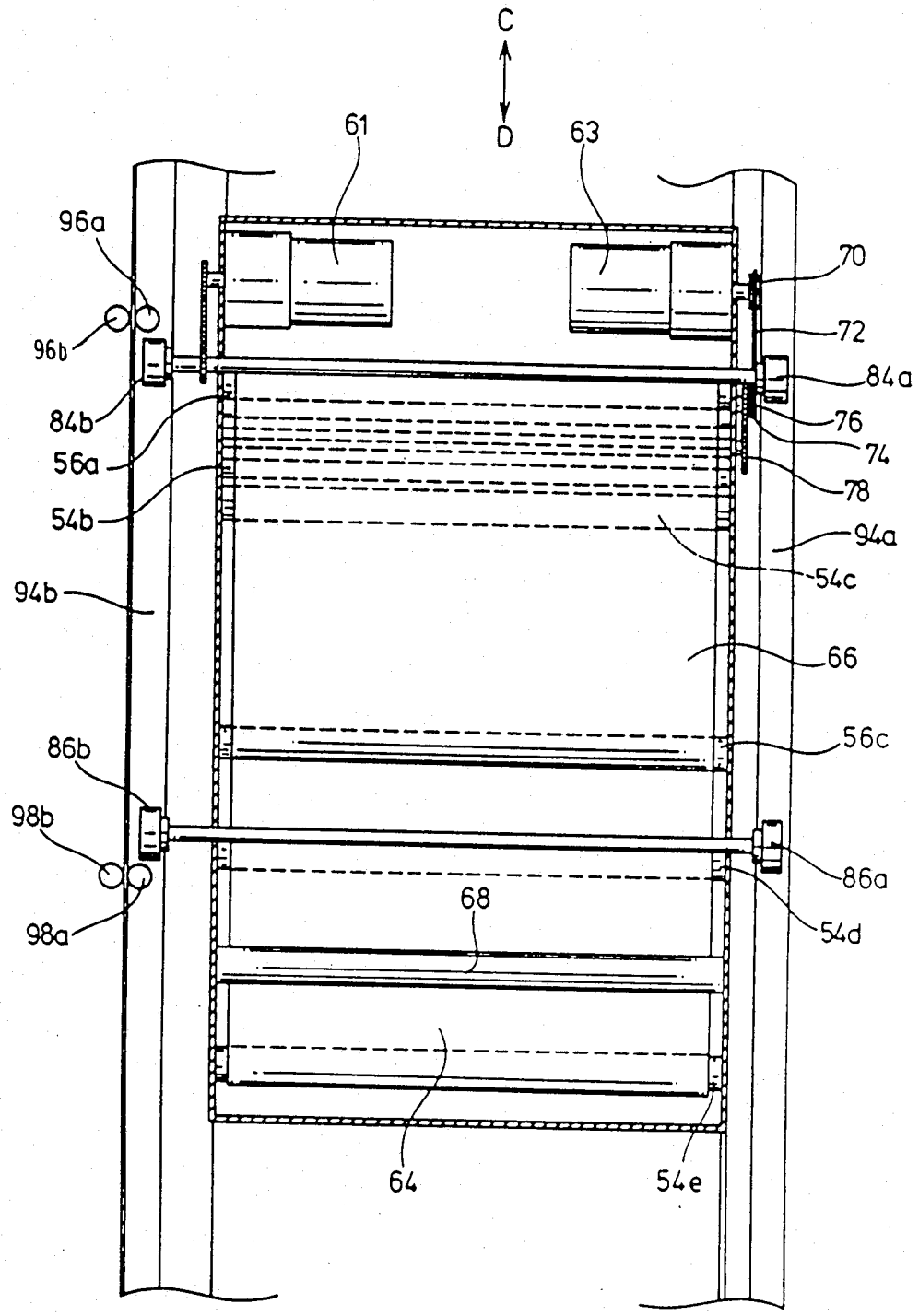
FIG. 6 is a fragmentary plan view, partly cut away, of the selective sheet feeder.
Figure 7:
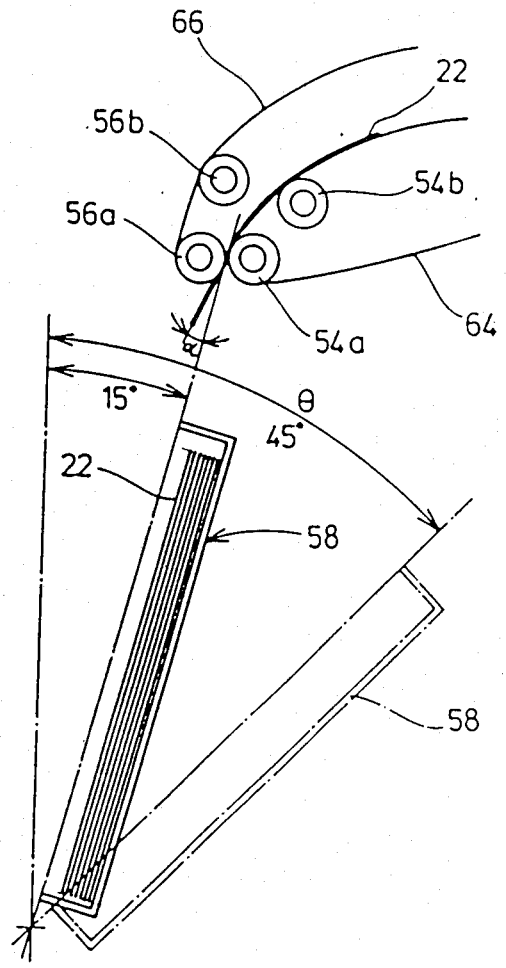
FIG. 7 is a schematic view showing the correlationship between the angle of inclination of a tray and the angle at which a sheet is discharged from rollers in a feed unit.

As illustrated in FIG. 5, the trays **58*a* through 58*g* of the sorter 60 are disposed below the angle members 94*a*, 94*b*, i.e., the horizontally movable casing 62. The trays 58*a* through 58*g* have different sizes in conformity with the sizes of stimulable phosphor sheets 22 to be sorted out. The trays 58*a* through 58*g* have openings directed upwardly and are inclined at an angle $\theta$ to the vertical direction. The angle $\theta$ should preferably be not larger than 45° in order to reduce the pressure on the surfaces of stacked stimulable phosphor sheets 22 in the trays, and should preferably be not less than 15° in order to prevent curled stimulable phosphor sheets from being displaced out of the trays when they are to be stacked therein. Although not shown, the trays 58*a* through 58*g* can manually be pulled through handles thereof toward the viewer of FIG. 5. As shown in FIG. 7, the belts 64, 66 have ends jointly serving as a sheet discharge outlet for discharging a stimulable phosphor sheet into the sorter 60 at an angle range of from $-5°$ to $+15°$ with respect to the angle at which the trays 58*a* through 58*g* are inclined. (The negative angle means an angle formed between the open side of the tray and a line directed from the open side into the tray.) With the direction of discharge of the sheets being selected to be in the above angle range, the stimulable phosphor sheet 22 can fall on the bottom of the tray or a stack of sheets thereon under a minimum pressure of contact. The trays 58*a* through 58*g* may have openings in their upper ends for introducing stimulable phosphor sheets thereinto. A cam plate 100 (FIG. 2) is fixed to the side panel 62*b* of the casing 62. As shown in FIGS. 2 and 5, the cam plate 100 has a plurality of rectangular slots 100*a* through 100*g* defined in its lower edge at spaced intervals therealong and leaving rectangular projections therebetween. A photoelectric detector 102 composed of a lightemitting element and a photodetector serves to detect such projections. The photoelectric detector 102 and the cam plate 100 are part of a control system for stopping the casing 62**.

The control system will be described with reference to FIG. 8.

The photoelectric detector 102 includes a phototransistor **102*a* having an output terminal connected to a Schmitt circuit 104 with its output terminal coupled to a monostable multivibrator 106. The monostable multivibrator 106 has an output terminal connected to one input terminal of a NAND gate 108. The output terminal of the Schmitt circuit 104 is also connected to the other input terminal of the NAND gate 108. The output from the NAND gate 108 is applied to the input terminal of a counter 112, and the output of the Schmitt circuit 104 is also fed to the counter 112. The counter 112 has an output terminal connected to a digital comparator 114 having an output terminal coupled to one input terminal of an AND gate 116. The output terminal of the AND gate 116 is coupled to a first amplifier 118. The output terminal of the NAND gate 108 is also coupled to a flip-flop 120 having its output terminal connected to a second amplifier 122. A command signal for movement toward an original position is fed to the flip-flop 120 and also to the other input terminal of the AND gate 116**.

Operation of the selective sheet feeder thus constructed is as follows:

The stimulable phosphor sheet 22 storing a radiation image of an object therein is fed by the first belt conveyor 24 and then starts to be fed by the nip roller 28 and the second belt conveyor 26 in the direction of secondary scanning. A laser beam emitted from the laser beam source 16 is reflected by the galvanometer mirror 18, as indicated by the dot-and-dash line, to scan the stimulable phosphor sheet 22 in the direction of primary scanning. The size of the stimulable phosphor sheet 22 introduced into the image read-out unit 10 is detected as through a bar code or the like attached thereto by a size detector (not shown), and a detected size signal is temporarily stored in a memory (not shown). The stimulable phosphor sheet 22 emits light upon stimulation by the laser beam, and the emitted light is detected through the light guide 12 by the photomultiplier 14 which converts the light into an electric signal. After the electric signal has been amplified, it is displayed as a visible image on a CRT or a suitable display device, or recorded as image information on a magnetic recording medium.

After the image has been read from the stimulable phosphor sheet 22, the sheet 22 is fed along the bent passage by the third belt conveyor 30, the rollers 32, and the fourth belt conveyor 34. Then, the stimulable phosphor sheet 22 is delivered via the first guide members 36 and the rollers 38 into the position between the second guide member 40 and the fifth belt conveyor 44. At this time, the sixth belt conveyor 48 and the seventh belt conveyor 50 are driven to rotate by a rotational drive source (not shown) to grip the stimulable phosphor sheet 22 therebetween. After the stimulable phosphor sheet 22 has been fed a prescribed distance by being gripped between the sixth and seventh belt conveyors 48, 50, they start being driven in the opposite direction to move the stimulable phosphor sheet 22 in a switchback path toward the fifth belt conveyor 44. The stimulable phosphor sheet 22 is therefore delivered by the fifth belt conveyor 44 into the casing 46 of the radiation image erase unit 42.

After the stimulable phosphor sheet 22 has been introduced into the casing 46, it is exposed to erasing light emitted from the erase light sources 45*a* through 45*d* to erase any remaining radiation image therefrom. Upon completion of the image erasure, the belt conveyor 44 is driven again to feed the stimulable phosphor sheet 22 back toward the second guide member 40, from which the stimulable phosphor sheet 22 is gripped by the sixth and seventh belt conveyors 48, 50 and delivered thereby to the sheet feed unit 52.

The belt driving motor 63 is now energized to rotate the gears 76, 78 in opposite directions via the chain 72. As a consequence, the rollers 56*a*, 54*a* are rotated to move the belt conveyors 54, 56 in opposite directions in contact with each other. That is, the belt 64 of the belt conveyor 54 is moved in the direction of the arrow A, whereas the belt 66 of the belt conveyor 56 is moved in the direction of the arrow B. The stimulable phosphor sheet 22 is first gripped between the belt 64 and the roller 68 and fed toward the belt 66. The belts 64, 66 then grip the stimulable phosphor sheet 22 therebetween, whereupon the motor 63 is temporarily de-energized.

As described above, the size information of the stimulable phosphor sheet 22 has been detected and stored in the memory in the read-out unit 10. The detected size signal is converted into a signal for driving the motor 61. As a result, the motor 61 is energized to rotate the sprocket 90, the chain 92, and the sprocket 88. Therefore, the rollers 84*a*, 84*b* are rotated to roll on the horizontal portions of the angle members 94 a, 94*b* to move the casing 62 in the direction of the arrow C (FIG. 2). The casing 62 can smoothly and reliably be moved along since the guide rollers 96*a*, 96*b* and 98*a*, 98*b* are held in rolling contact with the vertical portion of the angle member 94*b*.

The control system shown in FIG. 8 operates for sheet sorting as follows:

The output from the phototransistor 102*a* of the photoelectric detector 102 is supplied through the Schmitt circuit 104 serving as a waveform shaper to a short-pulse detector 110 composed of the monostable multivibrator 106 and the NAND gate 108. The monostable multivibrator 106 is triggered by a negative-going edge of the output of the Schmitt circuit 104 to produce an output pulse having a duration T. The output pulse from the monostable multivibrator 106 and the output from the Schmitt circuit 104 are fed to the NAND gate 108. The output of the Schmitt circuit 104 is also counted by the counter 112. The counter 112 is cleared by the output of the NAND gate 108. The count A of the counter 112 is supplied to the digital comparator 114 which contains binary data B corresponding to "0" through "6" assigned respectively to the trays 58*a* through 58*g*. The digital comparator 114 thus compares the count A of the counter 112 and the binary data B, and detects a coincidence therebetween. The detected output from the digital comparator 114 is inverted and applied to one of the input terminals of the AND gate 116, which is supplied at its other input terminal with the inverted command signal for movement to the original position. The output from the AND gate 116 is amplified by the first amplifier 118 and applied to the self-propelling motor 61 for enabling the same to move the feed unit 52 to the left (FIG. 5). The command signal for movement to the original position is also fed to the flip-flop 120 and sets the flip-flop 120 with its positive-going edge. The output signal from the flip-flop 120 is amplified by the second amplifier 122 and applied to the self-propelling motor 61 to enable the same to move the feed unit 52 to the right. The output from the NAND gate 108 is supplied to the counter 112 and the flip-flop 120 to clear them.

Figure 8:
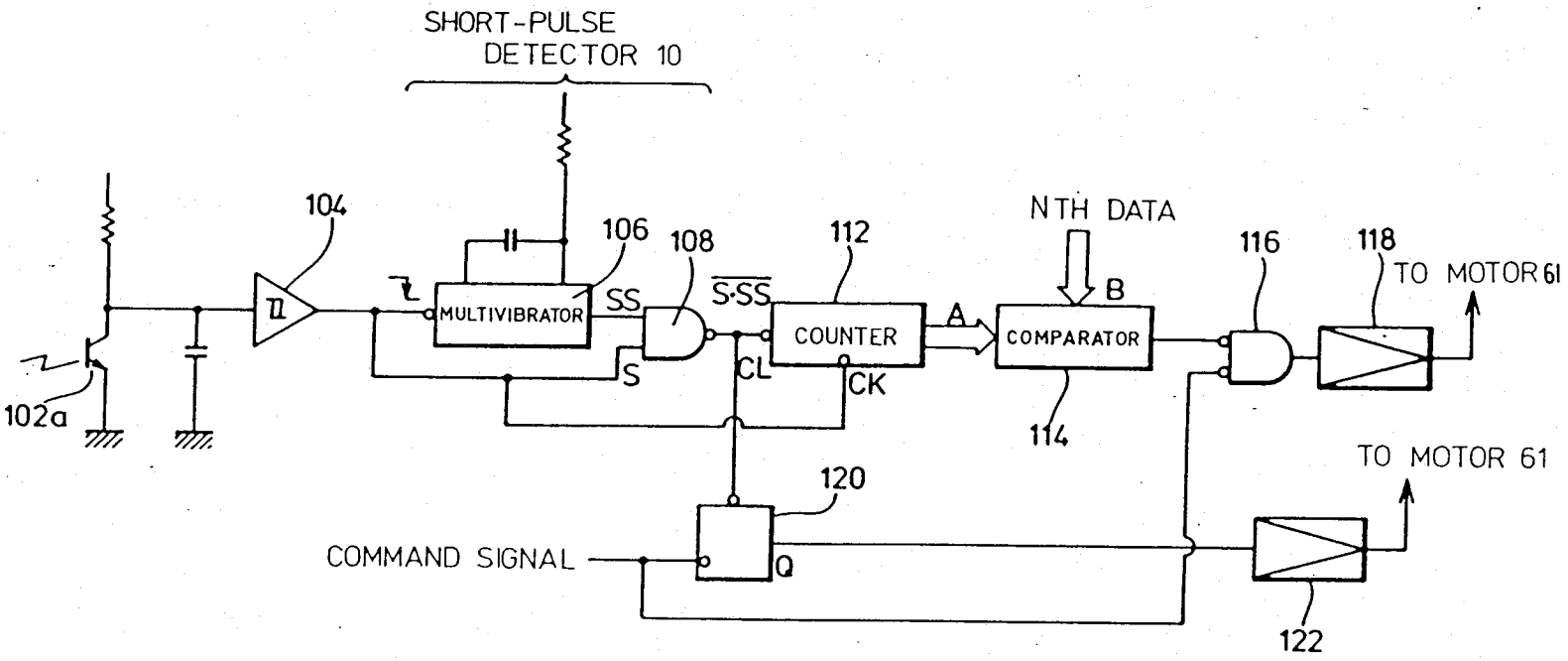
FIG. 8 is a block diagram of a control system for the selective sheet feeder.
Figure 9A:
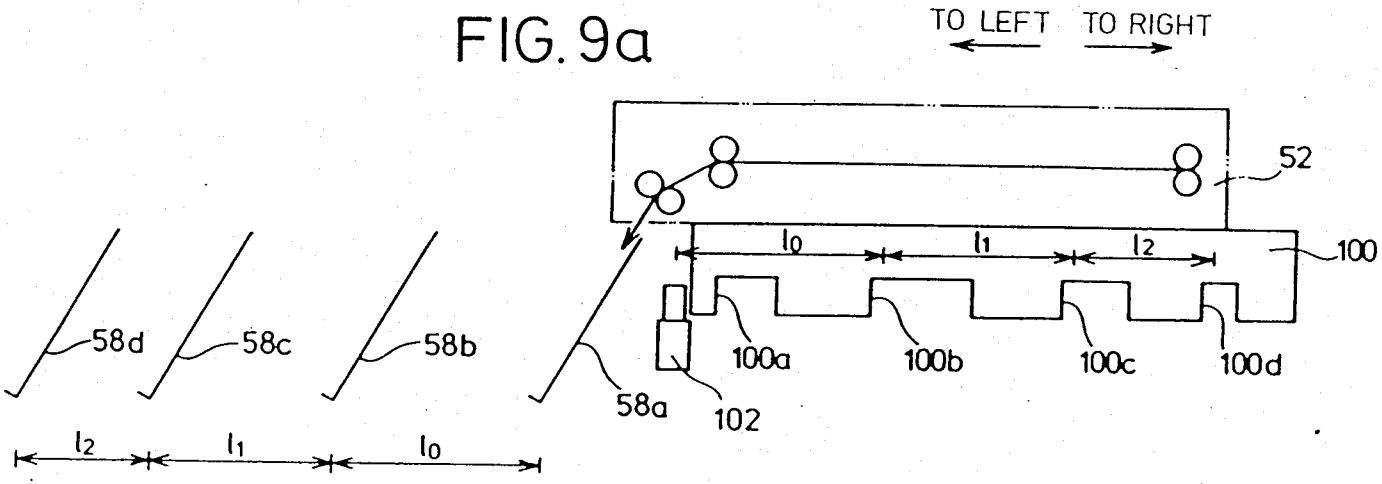
FIG. 9*a* is a schematic view of the feed unit, the trays, a cam plate, and a photoelectric detector.
Figure 9B:
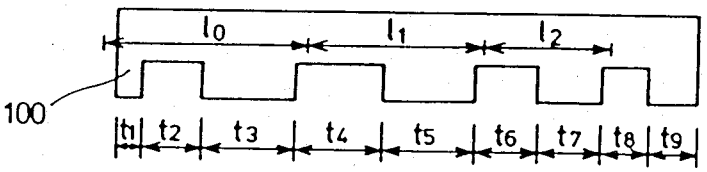
FIG. 9*b* is a front elevational view of the cam plate.

It is assumed here that the position of the tray 58*a* is denoted at "000", the distance between the trays 58*a*, 58*b* is $l_0$, the distance between the trays 58*b*, 58*c* is $l_1$, and the distance between the trays 58*c*, 58*d* is $l_2$, as shown in FIG. 8. As shown in FIG. 9*a* and 9*b* the slots 100*a* through 100*d* in the cam plate 100 are spaced the distances $l_0$, $l_1$, and $l_2$. The cam plate 100 has a narrower projection on the leftmost end for producing a short pulse. The projection on the leftmost end has a width t1, and the next slot has a width t2. The following successive projections have widths t3, t5, t7, t9, respectively, and the following successive slots have widths t4, t6, t8, respectively. The duration T of the output pulse from the monostable multivibrator 106 and these projection and slot widths have the relationship: $t1 < T < t2$ through t9.

Figure 10:
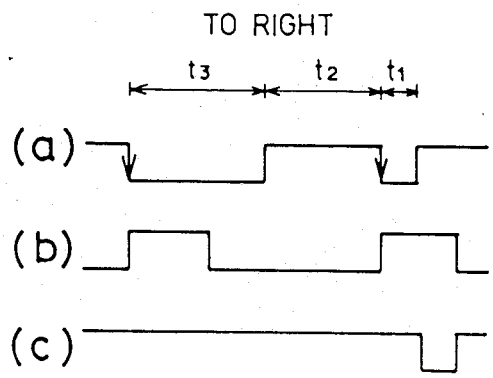
FIGS. 10 and 11 are diagrams showing signal waveforms explanatory of operation of the control system of FIG. 8.

When the command signal for movement to the original position goes high, i.e., when the selective feed unit 52 is to be moved to the original position, the AND gate 116 is closed since the inverted command signal is applied thereto, and the output from the digital comparator 114 does not pass through the AND gate 116. The flip-flop 120 is set by the command signal to make the Q output thereof high. The Q output of the flip-flop 120 is amplified by the second amplifier 122 and applied to the self-propelling motor 61 to move the feed unit 52 to the right. Upon movement of the feed unit 52 to the right, the photoelectric detector 102 generates a pulsed output signal as shown in FIG. 10(*a*) which corresponds to the shape of the cam plate 100. In response to negative-going edges of the pulsed output signal from the photoelectric detector 102, the monostable multivibrator 106 produces a pulsed output signal as shown in FIG. 10(*b*). The short-pulse detector 110 therefore generates an output, as shown in FIG. 10(*c*), when the projection of the cam plate 100 corresponding to the slot 100*a* thereof is positioned on the righthand side of the photoelectric detector 102 as illustrated in FIG. 8. The flip-flop 120 is cleared by the output pulse from the short-pulse detector 110. Therefore, the self-propelling motor 61 is de-energized in response to the output pulse from the short-pulse detector 110, holding the feed unit 52 at rest in the original position against further movement to the right.

While the command signal for movement toward the original position is low, the AND gate 116 remains open. With the binary data B supplied to the digital comparator 114, the digital comparator 114 continuously produces a low-level output until the binary data B coincides with the count A of the counter 112. Since the AND gate 116 is open, the output thereof is high while the output of the digital comparator 114 is low. As a result, the feed unit 52 is moved to the left by the self-propelling motor 61. As the feed unit 52 is moved to the left, the projection of the cam plate 100 corresponding to the slot 100*a* is detected by the photoelectric detector 102, which enables the short-pulse detector 110 to produce a pulse that clears the counter 112. If the binary data B given to the digital comparator 114 is "000" at this time, then the digital comparator 114 generates a high-level output to enable the AND gate 116 to produce a low-level output. Therefore, the self-propelling motor 61 is not energized, and the feed unit 52 remains in the original position.

Figure 11:
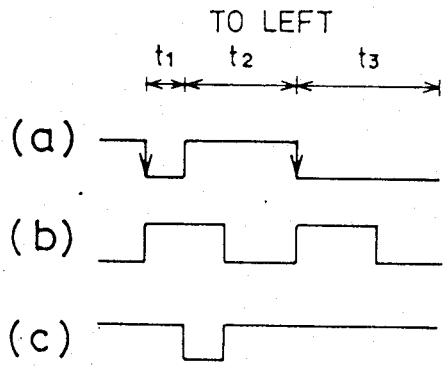

If the binary data B which is not "000" when the data B is applied to the digital comparator 108, then the self-propelling motor 61 is energized until the count A of the counter 112 coincides with the binary data B to move the feed unit 52 to the left. The pulsed output signals generated at this time are shown in FIG. 11. FIG. 11(*a*) shows the output of the Schmitt circuit 104, FIG. 11(*b*) the output of the monostable multivibrator 106, and FIG. 11(*c*) the output of the short-pulse detector 110.

Figure 12:
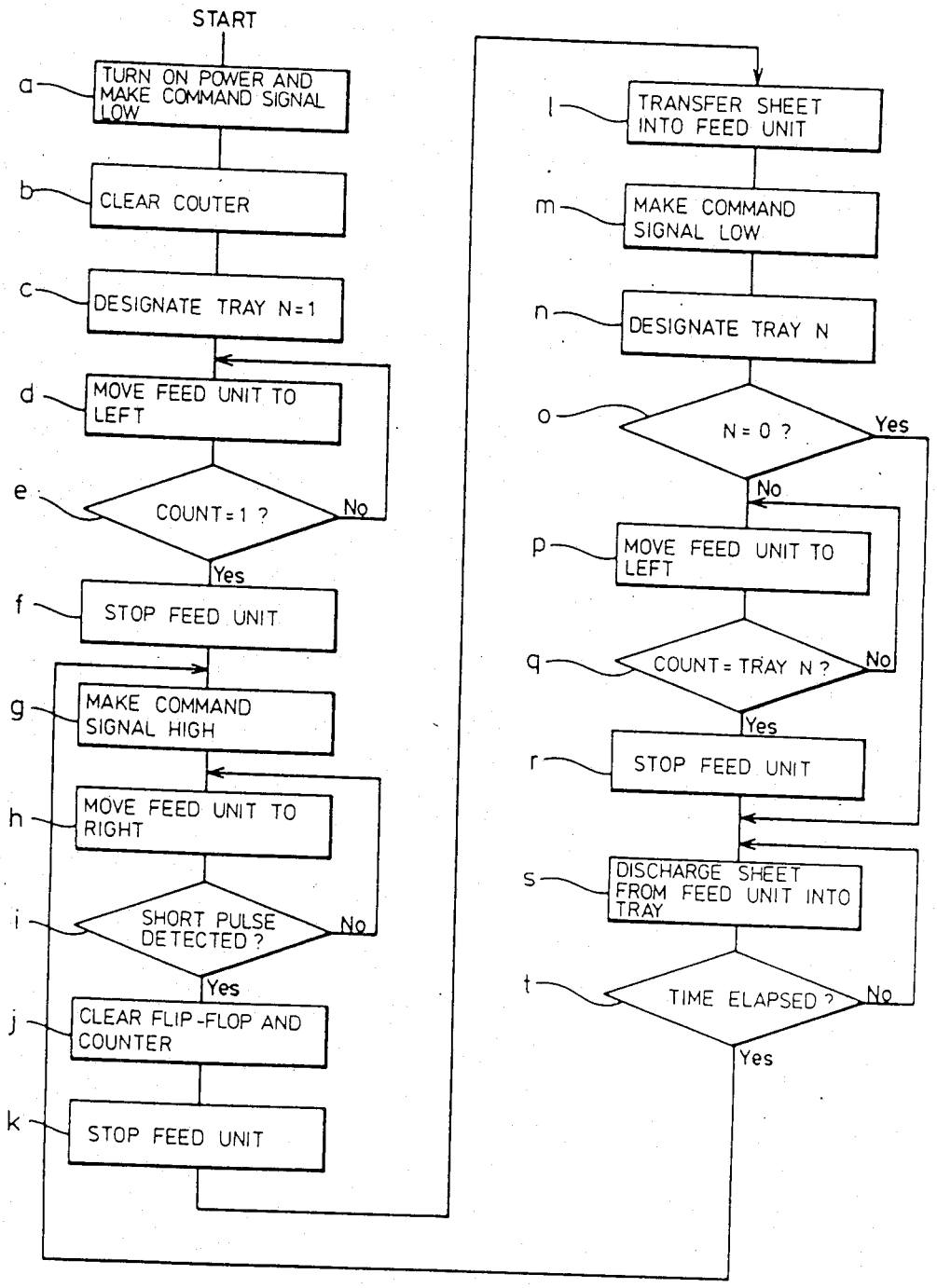
FIG. 12 is a flowchart of operation of the selective sheet feeder.

FIG. 12 shows a detailed flowchart of the operation of the control system.

As shown in FIG. 12, when the power supply is switched on, the command signal for movement toward the original position goes low in a step a, and the counter 112 is cleared in a step b. Binary data B "001" is fed to the digital comparator 114 in a step c. The binary data B "001" is given to the digital comparator 114 because the position of the feed unit 52 at the time the power supply is switched on is unknown. Then, the feed unit 52 is moved to the left in a step d, and a step e detects whether the count A of the counter 112 is "1" or not . If the count A of the counter 112 conincides with the binary data B in the digital comparator 114, then the feed unit 52 is stopped in a step f. The command signal for movement toward the original position goes high in a step g. The feed unit 52 is then moved to the right in a step h, and a step i detects whether the short-pulse detector 110 issues an output or not. If the short-pulse detector 110 issues an output, the flip-flop 120 is cleared in a step j to stop the feed unit 52 at the original position in a step k. The steps a through k correspond to initialization of the selective sheet feeder. Under this condition, the feed unit 52 is positioned at the rightmost position in its stroke, and the stimulable phosphor sheet delivered by the sixth and seventh belt conveyors 48, 50 is transferred into the feed unit 52 in a step 1. Then, the command signal goes low in a step m, and the detected size signal indicative of the size of the stimulable phosphor sheet is applied as the binary data B to the digital comparator 114 to designate a tray into which the stimulable phosphor sheet is to be stored in a step n.

A step o checks if the binary data B is "000" or not. If the binary data B is not "000" in the step 0, then the feed unit 52 is moved to the left in a step p until the count A of the counter 112 coincides with the binary data B in a step q. If the the count A of the counter 112 coincides with the binary data B in the step q, then the feed unit 52 is stopped in a step r above the tray designated in the step n. Then, the belt driving motor 63 is energized for a given period of time to drive the eighth and ninth belt conveyors 54, 56 for inserting the stimulable phosphor sheet into the tray in a step s. Upon elapse of a prescribed interval of time after the step s, the belt driving motor 63 is de-energized in a step t, which is followed by the step g. Therefore, the stimulable phosphor sheet is stored discharged into and in the desired tray.

Figure 13:
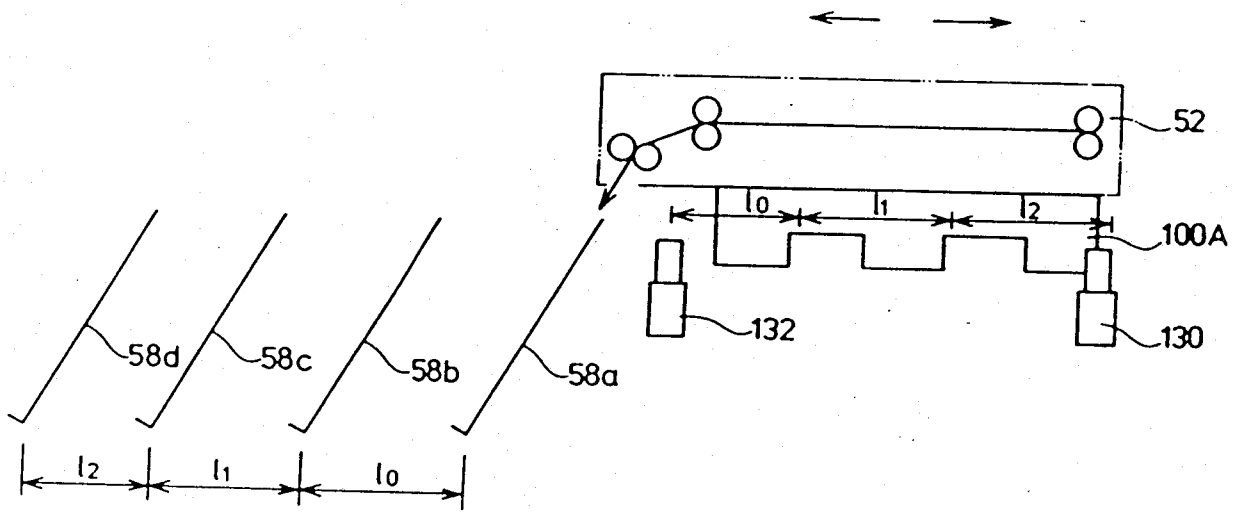
FIG. 13 is a schematic view of a feed unit, trays, a cam plate, and a photoelectric detector according to another embodiment.

FIG. 13 shows a selective sheet feeder according to another embodiment of the present invention, in which two photoelectric detectors are employed.

As shown in FIG. 13, a cam plate 100A attached to the casing 52 has no projection for generating a short pulse. The selective sheet feeder includes a photoelectric detector 130 for detecting the righthand end of the cam plate 100A to detect the original position, and a photoelectric detector 132 for detecting projections of the cam plate 100A. Each of the photoelectric detectors 130, 132 preferably comprises a phototransistor.

Figure 14:
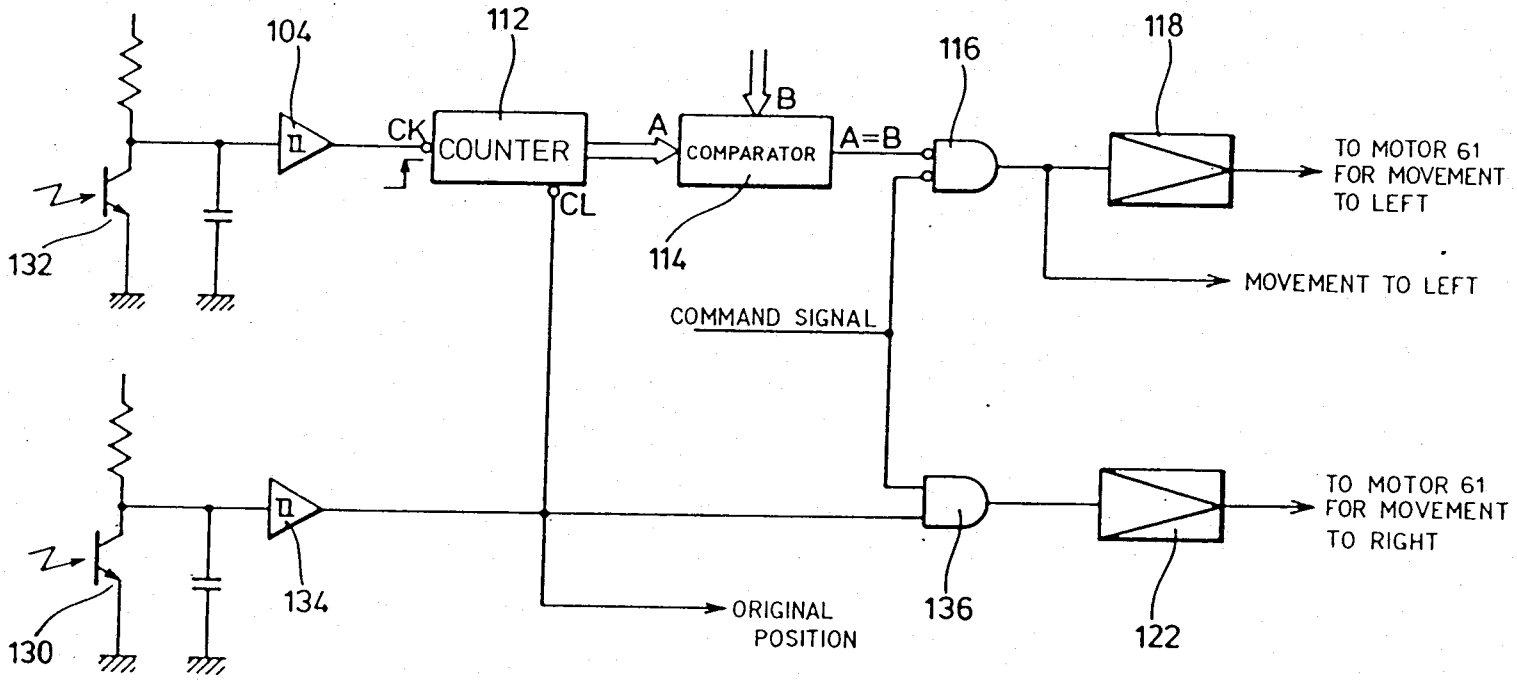
FIG. 14 is a block diagram of a control system according to the embodiment of FIG. 13.

As illustrated in FIG. 14, the output of the photoelectric detector 132 is supplied through the Schmitt circuit 104 to the counter 112, the count A of which is fed to the digital comparator 114. The digital comparator 114 compares the count A and the binary data B to detect a coincidence therebetween. The output of the digital comparator 114 is inverted and supplied to the AND gate 116 which is supplied as the other input with the inverted command signal for movement toward the original position. The output of the AND gate 116 is amplified by the first amplifier 118 and applied to the self-propelling motor 61 to move the feed unit 52 to the left.

The output from the photoelectric detector 130 is fed through a Schmitt circuit 134 to an AND gate 136 and also to the counter 112 as a clear signal. The AND gate 136 is also supplied as the other input with the command signal for movement toward the original position. The output of the AND gate 136 is amplified by the second amplifier 122 and applied to the self-propelling motor 61 to move the feed unit 52 to the right. The distances between the trays 58*a* through 58*d* and those between the slots in the cam plate 100A are related in the same manner as described above with respect to the preceding embodiment.

When the command signal for movement to the original position goes high, the AND gate 116 is closed to inhibit movement of the feed unit 52 to the left. At the same time, the AND gate 136 is opened to allow movement of the feed unit 52 to the right. The Schmitt circuit 134 generates a high-level output until the photoelectric detector 130 detects the cam plate 100A, so that the feed unit 52 is moved to the right by the self-propelling motor 61. When the cam plate 100A is detected by the photoelectric detector 130, the output thereof goes low, and the AND gate 136 is closed to stop the feed unit 52 in the original position. Simultaneously, the counter 112 is cleared.

When the command signal is low, the AND gate 136 is closed to prevent the feed unit 52 from moving to the right. At the same time, the AND gate 116 is opened. As a result, the output of the AND gate 116 is high to move the feed unit 52 to the left until the count A of the counter 112 coincides with the binary data B supplied to the digital comparator 114.

Figure 15:
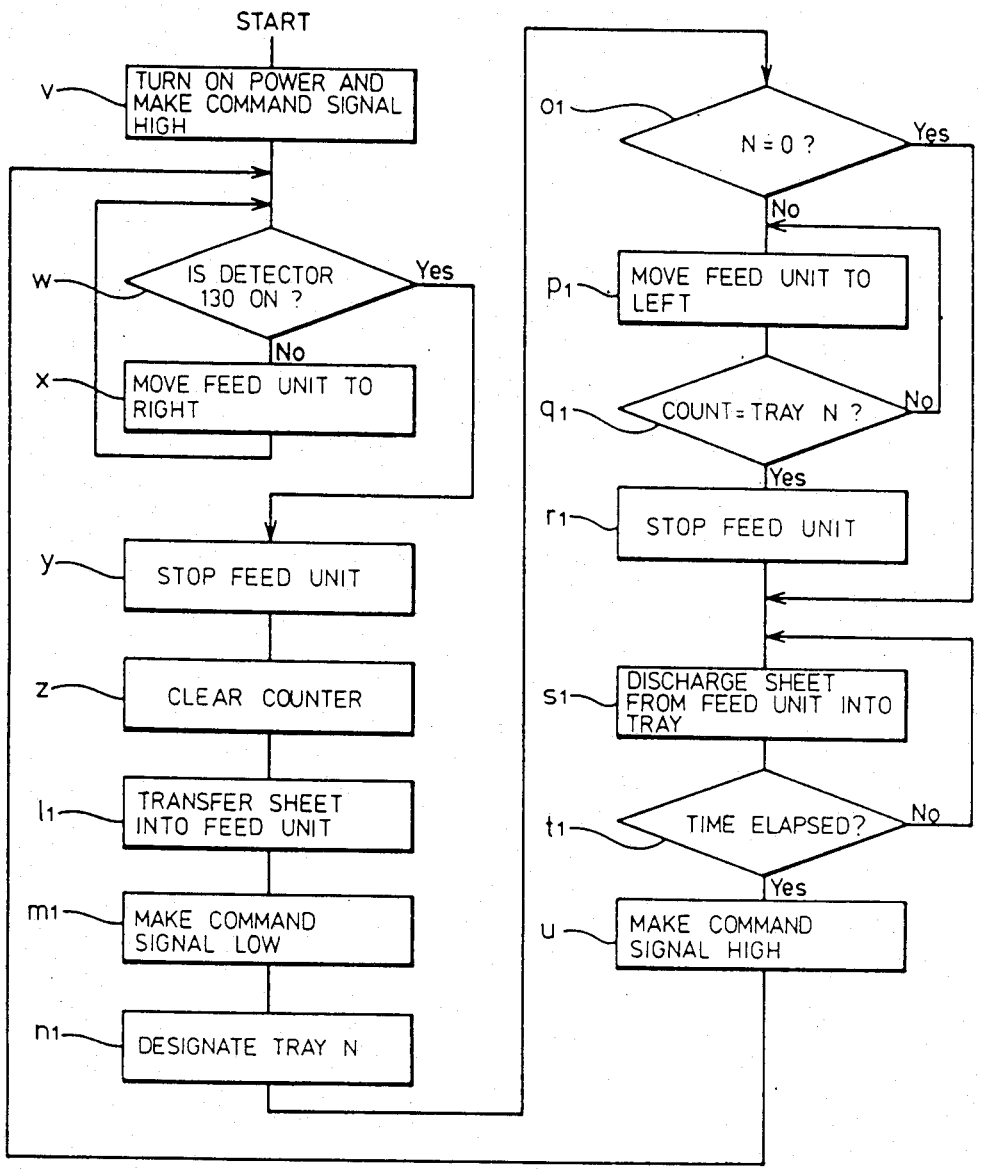
FIG. 15 is a flowchart of operation of the selective sheet feeder according to the embodiment of FIG. 13.
Figure 16:
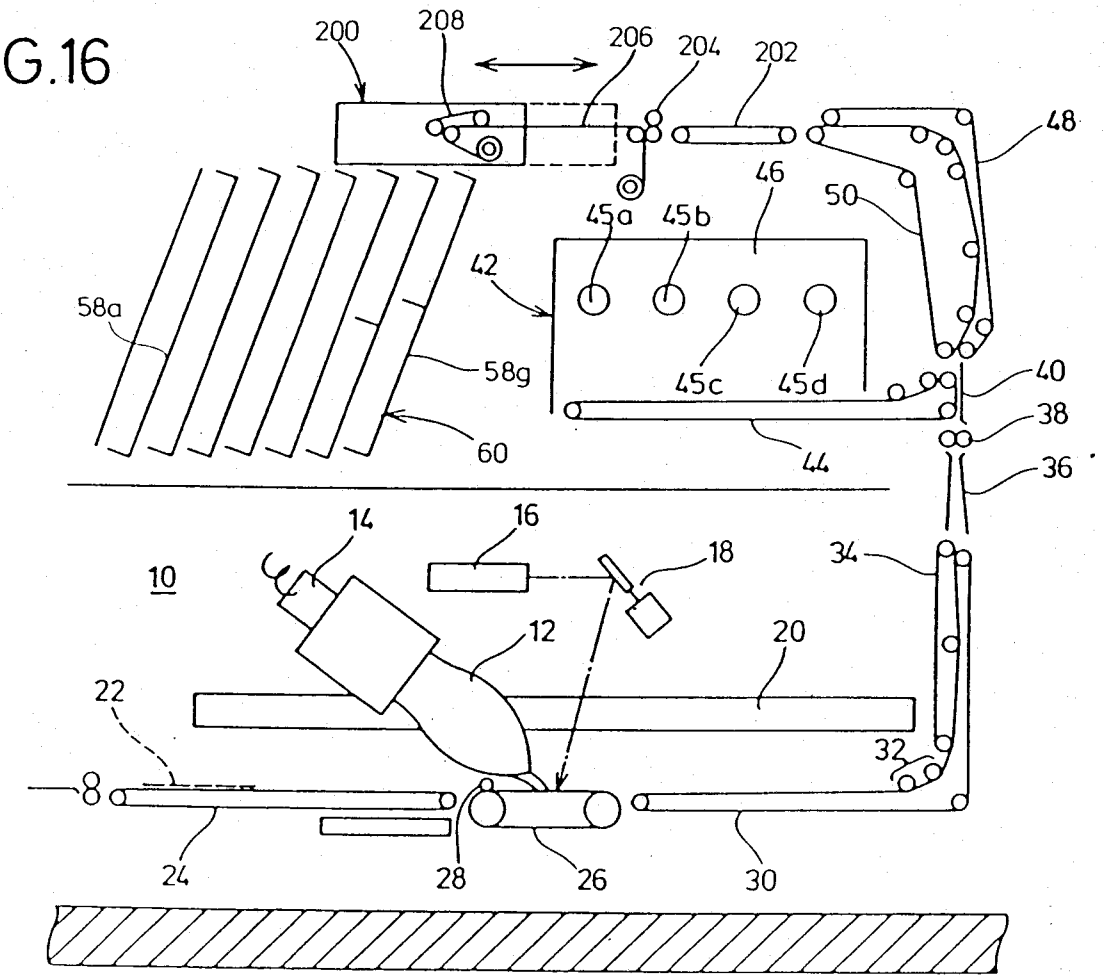
FIG. 16 is a schematic cross-sectional view of a radiation image reproducing system incorporating a selective sheet feeder according to still another embodiment of the present invention.

The above operation of the control system shown in FIG. 14 will be described in greater detail with reference to the flowchart of FIG. 15.

When the power supply is switched on, the command signal for movement toward the original position goes low in a step v. A next step w checks whether the photoelectric detector 130 detects the cam plate 100A. If the cam plate 100A is not detected by the photoelectric detector 130 in the step w, then the feed unit 52 is moved to the right in a step x. When the feed unit 52 reaches the original position, it is stopped in a step y. The step y is followed by a step z in which the counter 112 is cleared. Then, the stimulable phosphor sheet is transferred into the feed unit 52 in a step $1_1$.

The steps $1_1$ through $t_1$ correspond to the steps 1 through t shown in FIG. 12. After the step $t_1$, the command signal for movement toward the original position goes high in a step u. The step u is then followed by the step w. Thus, the stimulable phosphor sheet is stored into the desired tray.

Figure 17:
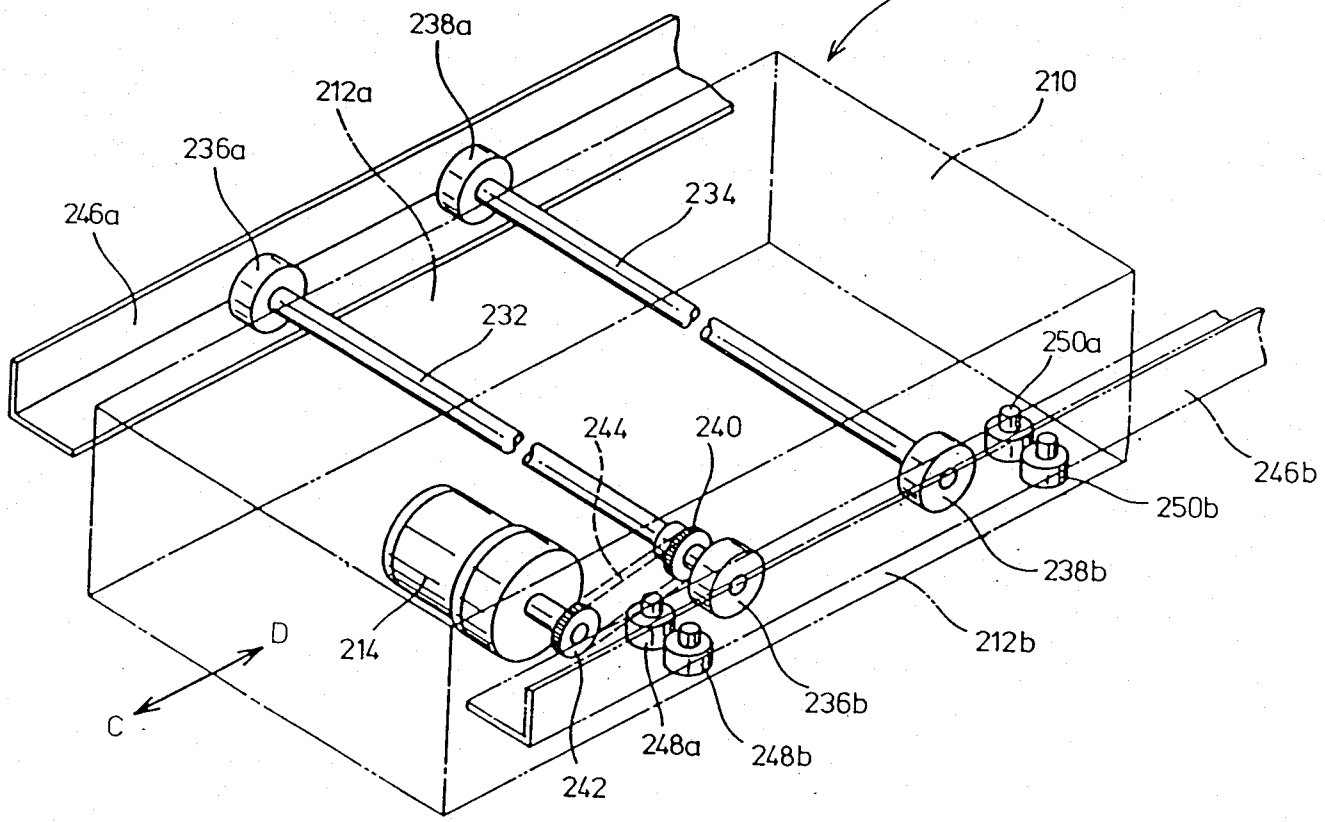
FIG. 17 is a perspective view of a self-propelling mechanism of the selective sheet feeder of FIG. 16.

FIGS. 16 through 19 show a selective sheet feeder according to still another embodiment of the present invention. The selective sheet feeder of this embodiment includes a sheet feed unit 200. An eighth belt conveyor 202 is horizontally disposed following the outlets of the sixth and seventh belt conveyors 48, 50, and has an outlet confronting nip rollers 204 disposed near an end of a ninth belt conveyor 206 which is part of the feed unit 200. The stimulable phosphor sheet 22 can be delivered by the nip rollers 204 into the feed unit 200. The feed unit 200 has a tenth belt conveyor 208 held in contact with the ninth belt conveyor 206. The feed unit 200 can itself be moved horizontally in the directions of the arrows C and D (FIG. 17). Below the feed unit 200, there is disposed the sorter 60 composed of a plurality of trays 58 as in the previous embodiments.

Figure 18:
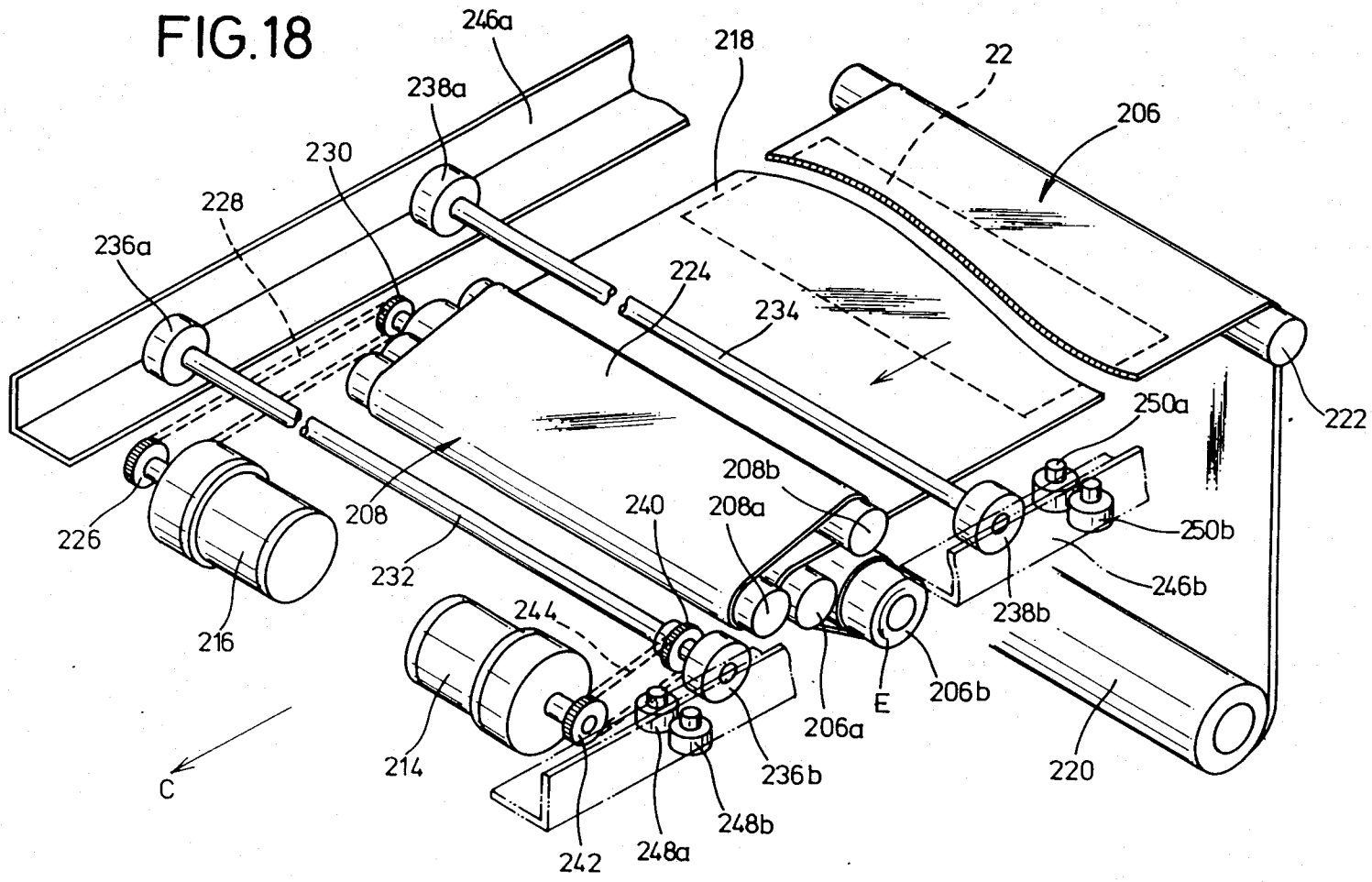
FIG. 18 is a fragmentary perspective view of a belt drive mechanism of the selective sheet feeder of FIG. 16.
Figure 19:
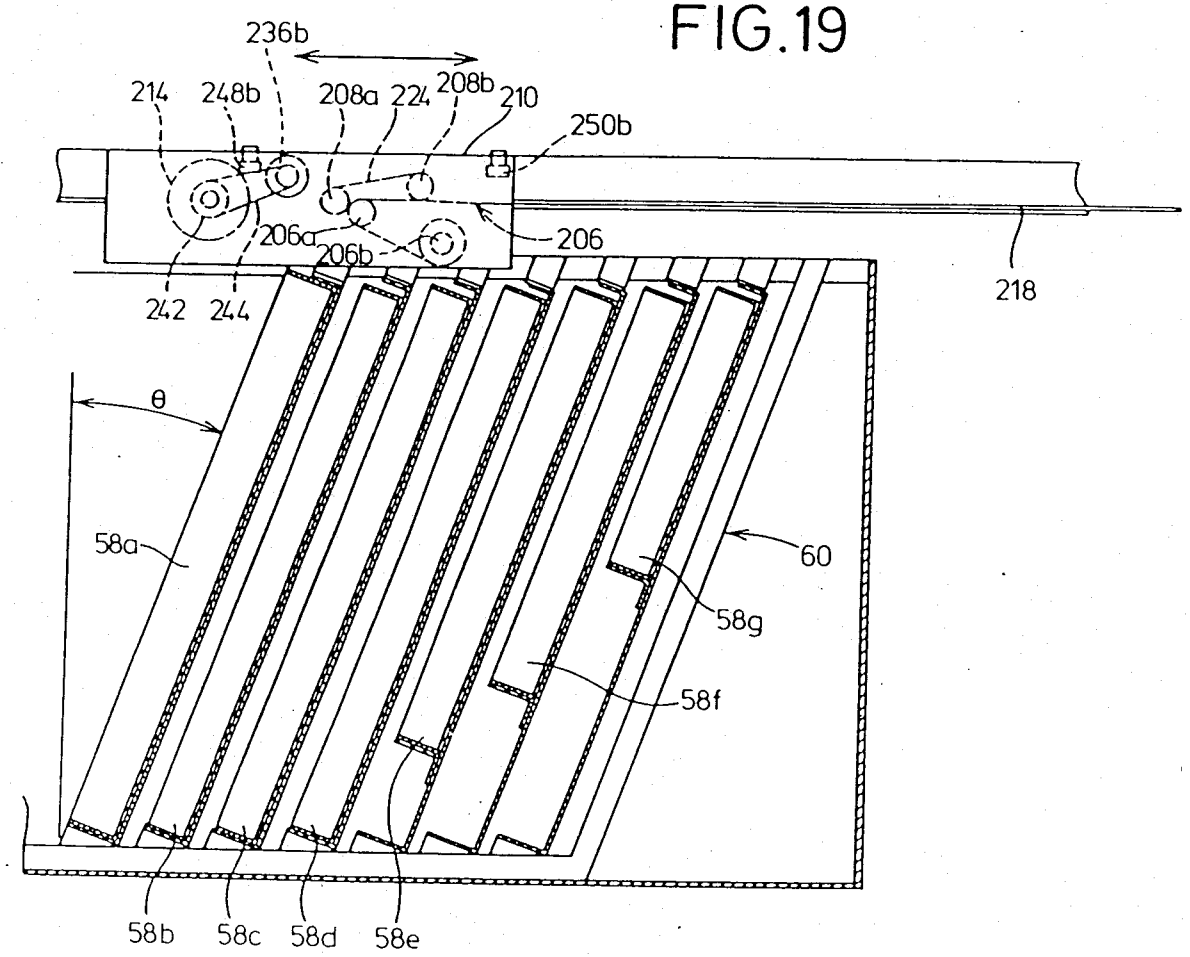
FIG. 19 is a front elevational view of the selective sheet feeder of FIG. 16 and a plurality of trays, shown in cross section, disposed below the selective sheet feeder.

The feed unit 200 will be described in more detail with reference to FIGS. 17 through 19.

The feed unit 200 has a casing 210 composed of opposite side panels **212*b*, 212*a* supporting a self-propelling motor 214 and a motor 216 for driving the belt conveyor 206, respectively. As illustrated in FIG. 18, the belt conveyor 206 comprises a roller 206*a* and a takeup roller 206*b* which are rotatably supported by the side panels 212*a*, 212*b*. A conveyor belt 218 is trained around the roller 206*a* and the takeup roller 206*b*. The conveyor belt 218 can be wound around the takeup roller 206*b* and has one end engaging the takeup roller 206*b*. The conveyor belt 218 is also trained around a roller 22 and has the other end engaging another takeup roller 220 biased by a spiral spring and rotatably supported on side walls (not shown). The belt conveyor 208 includes rollers 208*a*, 208*b* around which a conveyor belt 224 is trained. The rollers 206*a*, 208*a* are located closely to each other. The belt driving motor 216 has a rotatable shaft on which a sprocket 226 is mounted. A chain 228 is trained around the sprocket 226 and another sprocket 230 mounted on the rotatable shaft of the roller 206*a* which drives the belt conveyor 206**.

Two parallel rotatable shafts 232, 234 spaced from each other are rotatably supported on and extend between the side panels **212*a*, 212*b* of the casing 210. Rollers 236*a*, 236*b* are mounted respectively on the opposite ends of the rotatable shaft 232, and rollers 238*a*, 238*b* are mounted respectively on the opposite ends of the rotatable shaft 234. A sprocket 240 is mounted on the rotatable shaft 232. The self-propelling motor 214 has a rotatable shaft on which a sprocket 242 is mounted. A chain 244 is trained around the sprockets 240, 242. When the self-propelling motor 214 is energized, the rotative power is transmitted through the sprocket 242 and the chain 244 to the sprocket 240. The rollers 236*a*, 236*b* and the rollers 238*a*, 238*b* rollingly ride on the horizontal portions of parallel angle members 246*a*, 246*b*. Therefore, upon transmission of the rotative power from the motor 214 to the rollers 236*a*, 236*b*, these rollers 236*a*, 236*b* are positively driven to roll on the angle members 246*a*, 246*b* for thereby moving the casing 210 therealong. A pair of guide rollers 248*a*, 248*b* and another pair of guide rollers 250*a*, 250*b* are rotatably mounted on the casing 210 in gripping relation to the vertical portion of the angle member 246*b* for moving the casing 210 smoothly and reliably along the angle members 246*a*, 246*b***.

Operation of the selective sheet feeder thus constructed will be described below.

After the stimulable phosphor sheet 22 has been introduced into the casing 46, it is exposed to erasing light emitted from the erase light sources **45*a* through 45*d* to erase any remaining radiation image therefrom. Upon completion of the image erasure, the belt conveyor 44 is driven again to feed the stimulable phosphor sheet 22 back toward the second guide member 40, from which the stimulable phosphor sheet 22 is gripped by the sixth and seventh belt conveyors 48, 50 and delivered thereby to the eighth belt conveyor 202. Then, the stimulable phosphor sheet 22 is fed by the belt conveyor 202 and gripped and fed by the nip rollers 204 onto the belt conveyor 206. Prior to delivery of the stimulable phosphor sheet 22 by the nip rollers 204 to the belt conveyor 206, the feed unit 200 has been moved to the position of the tray having a size corresponding to the size of the stimulable phosphor sheet 22 which is delivered. The size of the stimulable phosphor sheet 22 introduced into the image read-out unit 10 is detected as through a bar code or the like by the size detector, and a detected size signal is temporarily stored in the memory. The detected size signal is converted into a signal for driving the motor 214. As a result, the motor 214 is energized to rotate the sprocket 242, the chain 244, and the sprocket 240. Therefore, the rollers 236*a*, 236*b* are rotated to roll on the horizontal portions of the angle members 246*a*, 246*b* to move the casing 210 in the direction of the arrow D (FIG. 17). The casing 210 can smoothly and reliably be moved along since the guide rollers 248***a*, 248*b* and 250*a*, 250*b*are held in rolling contact with the vertical portion of the angle member 246*b*. If the stimulable phoshpor sheet 22 delivered is of a maximum size, the self-propelling motor 214 moves the casing 210 to the front end of its stroke and is stopped to hold the casing 210 over the tray 58*a*. Therefore, the sheet discharge outlet defined by the ends of the belts 218, 224 is positioned to face the opening of the tray 58*a*. After the feed unit 52 has been stopped in position, the stimulable phosphor sheet 22 is delivered by the nip rollers 204 onto the belt conveyor 206, and then the belt driving motor 216 is energized. The rotative power of the motor 216 is transmitted to the chain 228 to rotate the sprocket 230 to thereby rotate the takeup roller 206*b* in the direction of the arrow E (FIG. 18) to feed the belt 218 in the direction of the arrow C against the winding force of the takeup roller 220 biased by the spiral spring. The stimulable phosphor sheet 22 on the belt 218 is moved therewith until it is gripped between the belts 218, 224. The belts 218, 224 held in contact with each other deliver the stimulable phosphor sheet 22 to the position of the rollers 206*a*, 208*a*, from which the stimulable phosphor sheet 22 is discharged through the sheet discharge outlet into the tray 58*a*.

After the stimulable phosphor sheet 22 has been stored in the tray 58*a*, the feed unit 200 is immediately moved to the position over a tray corresponding to the detected size of a next stimulable phosphor sheet to be stored. Then, the belt driving motor 216 is reversed to rotate the takeup roller 206*b* in the direction opposite to the direction of the arrow E for thereby returning the belt 218 to its starting position. At this time, the roller 220 is urged by the spiral spring to wind back the belt 218. The belt 218 is wound back around the roller 220 at a speed much higher than the speed at which it delivers the stimulable phosphor sheet 22 thereon, though the rewinding speed depends on the return force of the spiral spring. When the feed unit 200 has been moved to the desired tray position and stopped, the next stimulable phosphor sheet can then be delivered into the feed unit 200.

Figure 20:
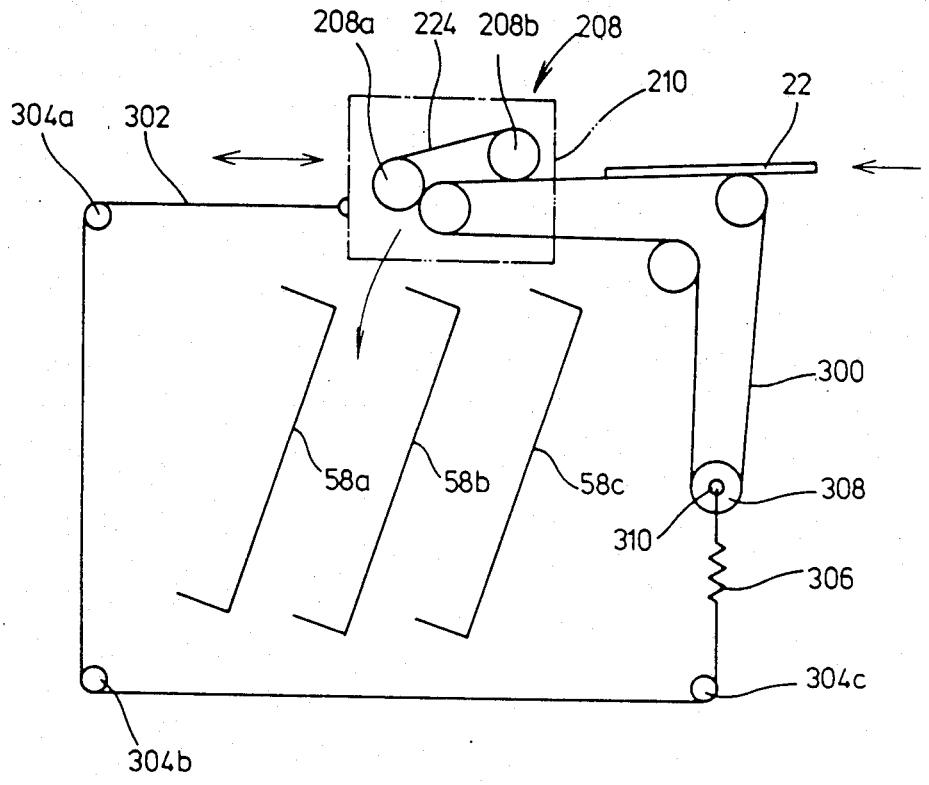
FIG. 20 is a schematic view of a selective sheet feeder according to a still further embodiment of the present invention.

FIG. 20 illustrates a selective sheet feeder according to a still further embodiment of the present invention.

The sheet feed unit 200 shown in FIG. 20 has an endless belt conveyor 300. The casing 210 of the sheet feed unit 200 is connected to one end of a wire 302 trained around rollers 304*a*, 304*b*, 304*c* and having its opposite end connected through a coil spring 306 to the shaft 310 of a roller 308. The endless belt of the endless belt conveyor 300 is trained around the roller 308. Therefore, the roller 308 can be moved with the feed unit 200 the same distance as that which the feed unit 200 is moved. The feed unit 200 can be moved to a desired tray position while keeping the belt conveyor 300 under constant tension at all times. The selective sheet feeder shown in FIG. 20 is more advantageous than the selective sheet feeder of FIGS. 16 through 19 in that the stimulable phosphor sheets can be fed and sorted out more rapidly since the time for winding back the belt 218 (FIG. 18) is not necessary.

With the arrangement of the present invention, stimulable phosphor sheets of different sizes and kinds can be sorted out and stored in correspondingly sized trays in preparation for recording next radiation images thereon. Since the vertically arranged trays are inclined, they take up a small space, and the overall selective sheet feeder can be constructed in a compact size. Immediately after one stimulable phosphor sheet has been stored into a corresponding tray, the feed unit is moved to the position of a tray in which a next stimulable phosphor sheet is to be stored. Therefore, different stimulable phosphor sheets can successively be stored selectively discharged into the trays at a high speed for storage. The sheet feed unit is delivered horizontally under the control of a sheet size signal obtained by the image read-out unit. Therefore, stimulable phosphor sheets of different sizes or kinds are prevented from being discharged into one tray. The selective sheet feeder is of a simple structure and can operate reliably and accurately. As no manual intervention is required for controlling the selective sheet feeder, it is economical and a labor saver.

The selective sheet feeder of the present invention is not limited to use in radiation image reproducing systems, but may be employed as a sorter mechanism for use in a copying machine.

Although certain preferred embodiments have been shown and described, it should be understood that many changes and modifications may be made therein without departing from the scope of the appended claims.

What is claimed is:

1. A selective sheet feeder comprising: a plurality of trays (58) having openings directed upwardly and inclined at a prescribed angle; and a sheet feed unit (52) movable along a travel path over said trays, said sheet feed unit including a casing (62), belt conveyor means (54,56) dispose in said casing, a first rotational drive source (63) for driving said belt conveyor means, and a second rotational drive source (61) for moving said sheet feed unit along said travel path, said sheet feed unit being movable, while a sheet (22) is held on said belt conveyor means, toward and stoppable in a position over a prescribed one of said trays, and said belt conveyor means being drivable by said first rotational drive source for discharging said sheet into said prescribed tray.

2. A selective sheet feeder according to claim 1, wherein each of said trays is inclined at an angle ranging from 15° to 45° with respect to the vertical line.

3. A selective sheet feeder according to claim 1, wherein said sheet feed unit includes at least one roller operatively coupled to a rotatable shaft of said second rotational drive source and held in rolling contact with said travel path, said roller being rotatable by said second rotational drive source to move said sheet feed unit along said travel path.

4. A selective sheet feeder according to claim 1, wherein said belt conveyor means comprises a pair of belt conveyors (54,56) held in contact with each other, said belt conveyors having ends jointly defining a sheet discharge outlet for discharging said sheet from said belt conveyors into said prescribed tray.

5. A selective sheet feeder according to claim 4, wherein said belt conveyors include respective rollers disposed closely to each other to define said sheet discharge outlet, and gears meshing with each other and mounted on the rotatable shafts of said rollers, respectively, said rotational drive source having a rotatable shaft operatively coupled to one of said rotatable shafts of said rollers, said rollers being rotatable in opposite directions through said gears by said rotational drive source for discharging said sheet from said sheet discharge outlet into said prescribed tray.

6. A selective sheet feeder according to claim 4, wherein said sheet discharge outlet is directed to discharge said sheet in a direction having an angle range of from −5° to +15° with respect to the angle at which said trays are inclined.

7. A selective sheet feeder according to claim 1, wherein said sheet comprises a stimulable phosphor sheet.

8. A selective sheet feeder comprising: a plurality of trays having openings directed upwardly and inclined at a prescribed angle; and a sheet feed unit (52) having a casing (62) and being movable along a travel path over said trays, said sheet feed unit including a belt conveyor, in said casing, for discharging a sheet carried thereon into one of said trays and a rotational drive source for driving said belt conveyor; detecting means for detecting the position of said sheet feed unit; designating means for designating a tray dependent on the inherent characteristics, including at least one of type and size, of the sheet carried on said belt conveyor; and control means for moving said sheet feed unit until the position of said sheet feed unit detected by said detecting means coincides with a tray position designated by said designating means and for energizing said rotational drive means to drive said belt conveyor when the position of said sheet feed unit coincides with said tray position.

9. A selective sheet feeder according to claim 8, wherein said sheet feed unit has a cam plate having a plurality of slots or projections corresponding to said trays, respectively, including photoelectric detector means disposed closely to said cam plate and coupled to said control means for enabling the latter to control the movement of said sheet feed unit based on a signal generated by said photoelectric detector means upon detection of said slots or projections.

10. A selective sheet feeder according to claim 9, wherein said photoelectric detector means comprises a single phototransistor, said cam plate having a narrower projection for enabling said phototransistor to detect when said sheet feed unit reaches an original position thereof.

11. A selective sheet feeder according to claim 9, wherein said photoelectric detector means comprises two phototransistors for detecting the front and rear ends of the stroke of travel of said sheet feed unit.

12. A selective sheet feeder according to claim 9, wherein said control means comprises a counter for counting pulses based on a signal from said detecting means while said sheet feed unit is moved along said travel path, a comparator connected to the output terminal of said counter for issuing a coincidence signal when said counter reaches a certain count, and gate means connected to the output terminal of said comparator and openable or closable for issuing a signal to move or stop said sheet feed unit when said sheet feed unit returns to an original position thereof.

13. A selective sheet feeder comprising: a plurality of trays having openings directed upwardly and inclined at a prescribed angle; and a sheet feed unit movable along a travel path over said trays, said sheet feed unit having a casing, a belt conveyor, having one end disposed in said casing and the other end disposed outside said casing, for delivering a sheet, a first rotational drive source for driving said belt conveyor, and a second rotational drive source, disposed in said casing, for moving said sheet feed unit along said travel path, said sheet feed unit being movable toward and stoppable in a position over a prescribed one of said trays, and said belt conveyor being drivable by said first rotational drive source for discharging said sheet into said prescribed tray through the opening thereof.

14. A selective sheet feeder according to claim 13, wherein said sheet feed unit includes at least one roller operatively coupled to a rotatable shaft of said second rotational drive source and held in rolling contact with said travel path, said roller being rotatable by said second rotational drive source to move said sheet feed unit along said travel path.

15. A selective sheet feeder according to claim 13, wherein said belt conveyor comprises a takeup roller at one end thereof, a roller operatively coupled to said first rotational drive source at the other end thereof, and a belt trained around said takeup roller and said roller.

16. A selective sheet feeder according to claim 13, wherein said belt conveyor comprises a first roller coupled directly to said first rotational drive source, a second roller disposed outside of said casing and at least one of rotatable and positionally variable in response to movement of said sheet feed unit, and a belt trained around said first and second rollers.

17. A selective sheet feeder according to claim 16, including a wire connected at one end thereof to said sheet feed unit, said second roller being coupled to the other end of said wire.

* * * * *